United States Patent [19]

Amaya et al.

[11] Patent Number: 4,458,258

[45] Date of Patent: Jul. 3, 1984

[54] IMAGE RECORDING METHOD

[75] Inventors: Mikio Amaya, Kawasaki; Masatoshi Kimura, Yokohama; Isao Kondo, Zama; Masakatsu Horie, Atsugi; all of Japan.

[73] Assignee: Fujitsu Limited, Kawasaki, Japan

[21] Appl. No.: 355,198

[22] Filed: Mar. 5, 1982

Related U.S. Application Data

[63] Continuation of Ser. No. 200,218, Oct. 24, 1980, abandoned.

[30] Foreign Application Priority Data

Nov. 6, 1979 [JP] Japan ..... 54-143598
Nov. 6, 1979 [JP] Japan ..... 54-143596

[51] Int. Cl.[3] ..... G03G 13/14

[52] U.S. Cl. ..... 346/153.1; 430/48; 430/126; 355/3 TE

[58] Field of Search ..... 101/DIG. 13; 346/1.1, 346/153.1, 155; 430/48, 126; 355/3 TE, 3 TR

[56] References Cited

U.S. PATENT DOCUMENTS 3,441,437 4/1969 Epstein et al. ..... 346/1.1 X
3,518,698 6/1970 Kazan et al. ..... 346/153.1
4,258,371 3/1981 Sekine et al. ..... 101/DIG. 1 X

*Primary Examiner*—John D. Welsh
*Attorney, Agent, or Firm*—Staas & Halsey

[57] ABSTRACT

A new image recording method, such as an electrophotographic method or electrostatic recording method, where a plurality of recording papers, each having visualized images, can be produced from an electrostatic latent image which is formed only once on the electrostatic latent image forming material. A recording material having a high resistance value and dielectric factor is laid on the electrostatic latent image forming material after an electrostatic latent image corresponding to a image to be recorded has been formed on said electrostatic latent image forming material. An electrostatic latent image on the recording material corresponding to the electrostatic latent image on the electrostatic latent image forming material is visualized by supplying developer to the surface of the recording material not facing or opposite to the electrostatic latent image forming material. Thereafter the developer on said recording material is fixed. In the same way, a recording paper having a plurality of the same image or recording papers with the same image can be produced as required by laying another recording material on the same electrostatic latent image forming material having the previously formed latent image and developing same.

17 Claims, 7 Drawing Figures

IMAGE RECORDING METHOD

This is a continuation of application Ser. No. 200,218 filed Oct. 24, 1980 now abandoned.

FIELD OF THE INVENTION

This invention relates to a recording method, such as an electrophotographic method or electrostatic recording method, where a plurality of recording papers having images of letters, symbols and figures can be obtained as required from an electrostatic latent image forming material which is only once subjected to the duplication or writing of the images to be formed on the recording paper.

BACKGROUND OF THE INVENTION

A recording method, where an electrostatic latent image is not formed directly on a specially manufactured particular recording paper, but instead where the image is formed on the electrostatic latent image forming material provided as the duplication medium, developed, and then duplicated onto a recording paper for providing the desired output image corresponding to an electrostatic latent image, is currently leading the recording system field because an ordinary paper can be used as the recording paper.

In the case of a recording system of this type, for example, in the electrophotographic recording system, an electrostatic latent image forming material 3 consisting of a conductive basic material 1 and photoconductive insulation layer 2 is at first charged by the positive (or negative) ion in a corona discharger as indicated in the charging process step (a) of FIG. 1. Then, as indicated in the exposing process step (b), the electrostatic latent image forming material 3 is subjected to light irradiation 6, such as by the close exposing or projected exposing method, and thereby an electrostatic latent image 7 corresponding to letters, symbols and figures is formed on the surface of the electrostatic latent image forming material 3.

Then, as indicated in the developing process step (c) of FIG. 1 negatively (or positively) charged developer particles 9 are supplied to the surface of the electrostatic latent image forming material 3 by a developing roller 8 or other means and thereby the developer particles 9 are fixed on the elestrostatic latent image 7. Thus the electrostatic latent image is visualized and a visualized image 10 is obtained.

As indicated in the duplication process step (d) of FIG. 1 recording paper 11 is laid on the visualized image 10 of the electrostatic latent image forming material 3 and the recording paper 11 is charged with the charges in the same polarity as the latent image by means of a corona discharger 12 for duplication. Thus a visualized image 10 consisting of the developer particles 9 is duplicated on the recording paper 11. Then, as indicated in the fixing process step (e), the surface of the recording paper 11 is heated by a heater, such as an infrared ray lamp 13, and the developer particles are melted or fused on the recording paper 11. A visualized image 10 is thus fixed on paper 11.

The conventional recording method, as indicated in FIG. 1, has the following disadvantages as compared with the method of this invention described later.

First, since development on the electrostatic latent forming material 3 is carried out by using or placing the developer particles 9 thereon with a visualized image then being duplicated on the recording paper 11 by the transfer of the particles 9, the developer particles 9 which are not used for duplication remain on the electrostatic latent image forming material 3 and they contaminate the surface of the electrostatic latent image forming material 3 after repeatedly forming electrostatic latent images on the material 3. Therefore, cleaning of the material 3 is essential in order to prevent such contamination. The application efficiency of the developer particles 9 is thus deteriorated.

In addition, the surface of the electrostatic latent image forming material 3 is easily damaged by the mechanical contact a cleaning brush or the like in the cleaning process.

Moreover, this method results in a shortened expected life of the electrostatic latent image forming material because the mechanical contact of a magnetic brush, etc., to the electrostatic latent image forming material surface is indispensable in the development process. Therefore, the electrostatic latent image forming material replacement frequency inevitably increases and maintenance work is also complicated.

Meanwhile, duplication of the image onto the recording paper is achieved by transferring the electrostatic charges to the recording paper 11 and resultingly the latent image 7 on the electrostatic latent image forming material 3 disappears. Thus, after the duplication process step occurs, it is no longer possible to obtain the desired visualized image when development is attempted again on the electrostatic latent image forming material. For this reason, the series of process steps from (a) to (d) must always be repeated in order to obtain a plurality of duplicated images.

OBJECTS AND SUMMARY OF THE INVENTION

An object of this invention is to realize a new image recording method which will not cause damage on the surface of the electrostatic latent image forming material and resultingly is not subjected to such a limitation that materials having particularly high mechanical strength must be selected for the electrostatic latent image forming material.

Another object of this invention is to realize an image recording method which will reduce the replacement frequency of an electrostatic latent image forming material and assure easy maintenance.

Still another object of this invention is to realize a novel image recording method which is capable of producing a plurality of visualized images from the same electrostatic latent image formed on the electrostatic latent image forming material.

Offered by this invention is an image recording method characterized by the following:

a positive or negative electrostatic latent image is formed on the surface of an electrostatic latent image forming material corresponding to an image to be recorded, thereafter a recording material having a high resistance value and dielectric coefficient is laid on said electrostatic latent image forming material, an electrostatic latent image on said recording material corresponding to an electrostatic latent image of said electrostatic latent image forming material is visualized by supplying the developer to the surface of said recording material which is not facing said electrostatic latent image forming material, and thereafter the developer on said recording material is fixed.

Further offered by this invention is an image recording method characterized by the following:

a positive or negative latent image is formed on the surface of an electrostatic latent image forming material corresponding to an image to be recorded, thereafter a recording material having a high resistance value and dielectric coefficient is laid on said electrostatic latent image forming material, an electrostatic latent image on said recording material corresponding to an electrostatic latent image on said electrostatic latent image forming material is visualized by supplying the developer to the surface of said recording material which is not facing said electrostatic latent image forming material, thereafter an ordinary recording paper is laid on the recording material storing the visualized image and the visualied image formed on said recording material is duplicated to an ordinary recording paper by the duplicating process, thereafter the developer on said ordinary recording paper is fixed.

Further features and advantages of the present invention will be apparent from the ensuing description with reference to the accompanying drawings to which, however, the scope of the invention is in no way limited.

DETAILED DESCRIPTION OF THE INVENTION

An image forming process of an image recording method of this invention will be explained by referring to FIG. 2.

In this explanation, a layer structure consisting of a conductive base material 1 and a photoconductive insulation layer 2 formed on said conductive base material 1 is used as an electrostatic latent image forming material 3.

Figure 1:
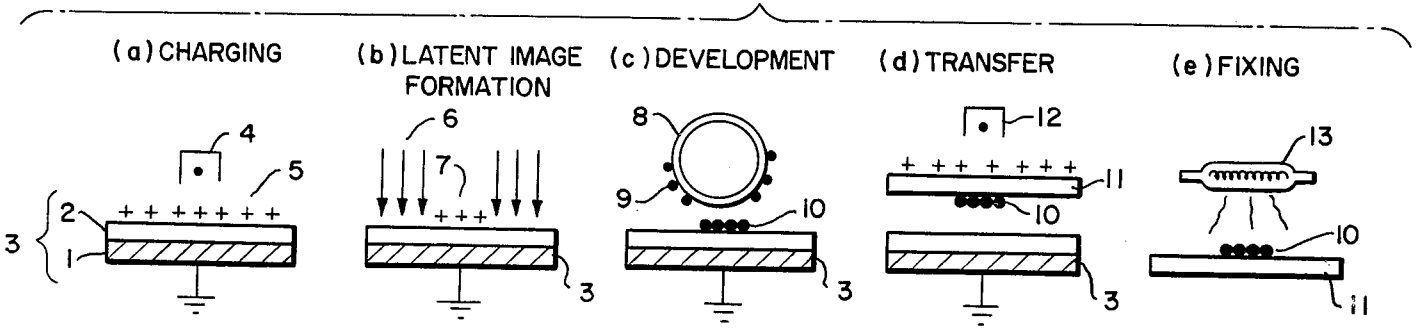
FIG. 1. (PRIOR ART)
FIG. 1 explains the recording processes of the conventional image recording method.

The charging and image exposing process steps to the electrostatic latent image forming material 3 are performed in the same manner as the conventional method represented by the recording method disclosed in FIG. 1. Therefore, no further explanation for these processes is made herein.

In the development process step (c), a recording layer or material 14 is laid on or positioned above the surface of electrostatic latent image forming material 3 and developer particles 9 are supplied to the surface of the recording material 14 which is not facing or opposite to the electrostatic latent image forming material 3 by a developer roller 8 or other means, and thereby a visualized image 10 is formed on the surface of said recording material 14. Desirably, the recording material 14 should have a high resistance value, for example, $10^{12}$ ohms cm to $10^{16}$ ohm cm, should be a high quality paradielectric having dielectric coefficient of, for example, 1.2 to 3.5, and should be finished in the form of a sheet having a thickness, for example, of 25 $\mu$m.

More specifically, the recording material discussed above preferably is a film consisting of macromolecule materials, such as polystyrole, polyethylene, polyvinyl chrolide, ethylene tetra fluoride and poly-prolylene, etc., and a paper which has been subjected to an insulation processing.

In the fixing process step (d), the surface of recording material 14 is heated by a heater, such as an infrared ray lamp 13, and thereby a visualized image 14 can be fixed on the recording material.

As summarized below, the characteristics of this invention are compared with a conventional electrophotographic image recording method as indicated in the FIG. 1. A recording method of this invention does not require the duplication process, including transfer step (d), since the development of the latent image is carried out directly on the surface of the recording material 14 to obtain the visualized image 10. Thus, this also rules out the cleaning process which is inevitably required in the conventional method, since no developer particles 9 remain on the electrostatic latent image forming material 3. Moreover, the application efficiency of the developer particles used in the development process is notably high in the case of this invention because it is all used for a visualized image 10.

Figure 2:
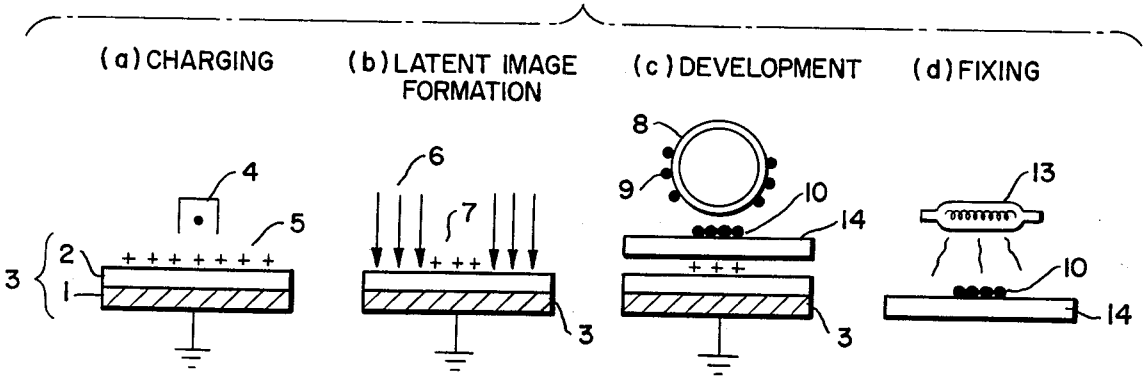
FIG. 2 explains the recording processes of an image recording method of this invention.

It is the most remarkable characteristic of this invention that the development of the latent image is carried out directly at the surface of recording material 14 in the development process step (c) of FIG. 2. Thus, even after the recording material 14 forming a visualized image 10 is removed from the surface of electrostatic latent image forming material 3, the latent image 7 on the electrostatic latent image forming material 3 does not disappear and still remains. Therefore, the visualized image 10 can be formed again on the recording material 14 by laying or placing another new recording material 14 on the electrostatic latent image forming material 3 and repeating the development process step (c) of FIG. 2. Repetition of such development processes of this invention ensures obtaining a plurality of the visualized image 10 from the same electrostatic latent image 7 formed on the electrostatic latent image forming material 3.

Figure 3:
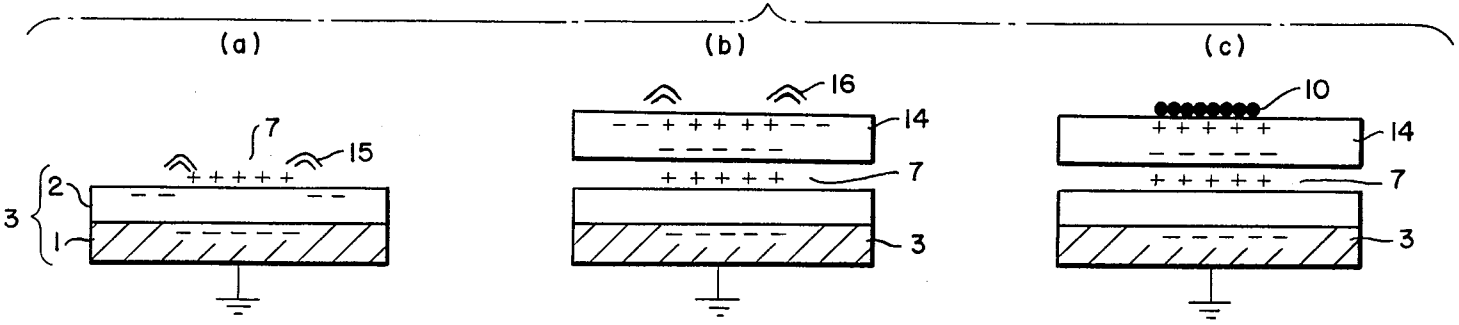
FIG. 3 explains the principle of obtaining a plurality of recorded images in this invention.

The principle of obtaining a plurality of recordings in the present invention is explained by referring to FIG. 3.

FIG. 3(*a*) shows the condition immediately after an electrostatic latent image 7 is formed on the electrostatic latent image forming material 3. In this case, the electrostatic latent image 7 is formed by the positive ion charges on the surface of photoconductive insulation layer 2, while the negative charges appear on the conductive base material 1. At this time, the positive ion charges generate an electric field 15 in the space as noted on the drawing. In the ordinary development process step of the electrophotographic recording method, the developer particles 10 are attracted to the surface of the photoconductive insulation layer 2 by the effect of this electric field 15.

In the case of this invention, when said recording material 14 is laid on the surface of electrostatic latent image forming material 3 as indicated in (b) of FIG. 3, general internal polarization occurs in the recording material 14 by the effect of the electric field 15 generated by the positive ion charges. That is, virtual negative charges are gathered on the recording material 14 in the side facing the electrostatic latent image forming material 3, while virtual positive charges gather on the surface of the dielectric material 14, thus generating a virtual electric field 16 in the space as noted in the drawing. As indicated in FIG. 3(*c*), when the developer particles 9 are supplied to the recording material 14, an electrostatic latent image 7 and a visualized image 10 of the same shape are formed.

When the recording material 14 is removed from the electrostatic latent image recording material 3, effect of the ion charges disappears and the internal polarization of recording material 14 is neutralized, but a visualized image 10 remains in the present shape on the recording material 14. Moreover, an electrostatic latent image 7 on the electrostatic latent image forming material 3 remains in the present shape as indicated in step (c) of FIG. 3 since the ion charge shift or transfer does not occur, and the condition of step (a) of FIG. 3 is reproduced again. As can thus be seen, a plurality of images can be obtained by repeating the process steps (a), (b) and (c). The limitation of the number of recordings depends upon the speed in which charges disappear by the dark attenuation of the photoconductive insulation layer 2.

In the above illustration the electrophotographic method was described. However, it is also possible to use a dielectric layer having a high insulation characteristic in place of the photoconductive insulation layer 2. In this case, the dielectric layer surface is caused to discharge through a pin electrode and thereby an electrostatic latent image is formed on the dielectric layer surface. Since the attenuation period of a dielectric layer is considerably long, the electrostatic latent image can be held on the surface for a long period of time by employing this electrostatic recording method and therefore a greater number of duplicated images can be obtained.

This invention is also applied to a method using an electrostatic latent image forming material having a so-called three layer structure where a thin dielectric layer is formed on the photoconductive insulation layer 2.

This invention also offers a method of obtaining a plurality of duplicated images on an ordinary recording paper from the same electrostatic latent image. This method is explained by referring to FIG. 4.

Figure 4:
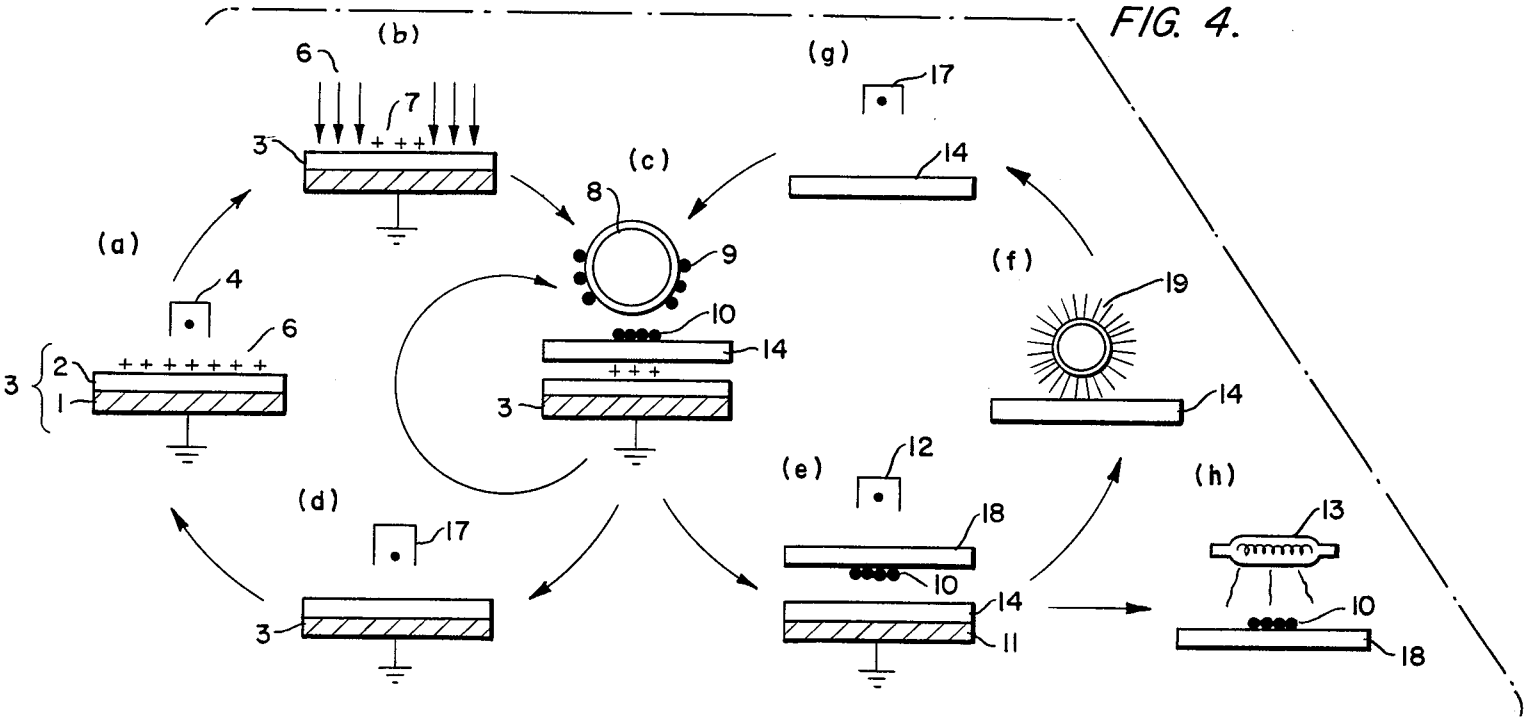
FIG. 4 explains the processes for forming an image on the ordinary recording paper in this invention.

The process steps indicated respectively in (a), (b) and (c) of FIG. 4 are the same as those shown in FIG. 2. FIG. 4(*d*) is the process step for erasing an electrostatic latent image 7 on the electrostatic latent image recording forming material 3 by use of a discharging corotron 17. For new image recording, the electrostatic latent image forming material 3 is subjected to the process steps (a), (b), (c) and (d) of FIG. 4, and for duplication of a plurality of images from the same latent image once it is formed, it is subjected again only to the process step (c) of FIG. 4, omitting the process steps (a), (b) and (d) of FIG. 4.

Further to the above processes, after forming a visualized image 10 on the recording material 14 in the process step (c) of FIG. 4, the material 14 with image 10 is laid on a conductive base material 11, and morover an ordinary recording paper 18 is laid thereon. Thereby, the visualized image 10 is duplicated onto the ordinary recording paper 18 from the recording material 14 by means of the duplication corotron 12. This is shown as step (e) in FIG. 4. Thereafter, in a process step (f) of FIG. 4, the remaining developer particles 9 on the recording material 14 are removed by means of a cleaning brush 19, and in the process step (g) of FIG. 4 the recording material 14 is discharged by a discharging corotron 17 for providing a uniform potential on the material after dupication. As indicated in process step (h) of FIG. 4, the ordinary recording paper 18 is heated, such as by an infrared ray heater, and thereby a visualized image 10 is fixed on that paper.

By repeating the process steps (c), (e), (f) and (g) of FIG. 4 for the recording material 14, the image on recording material can be duplicated or provided on a plurality of ordinary recording paper 18.

In the above embodiment, a photoconductive insulation layer is used as the electrostatic latent image forming material, but this invention is not necessarily limited to this and can also be adopted to a dielectric layer or multi-layer structure formed of a photoconductive insulation layer and dielectric layer. As is described for the above embodiment, this invention can be adopted not only to the photosensitive body exposing method but also to the pin electrode recording method using the dielectric layer as the method of forming an electrostatic latent image. Moreover, this invention can be adopted not only to the process of charging—positive development, but also to the process of discharging—inverted development, in the same way.

Figure 5:
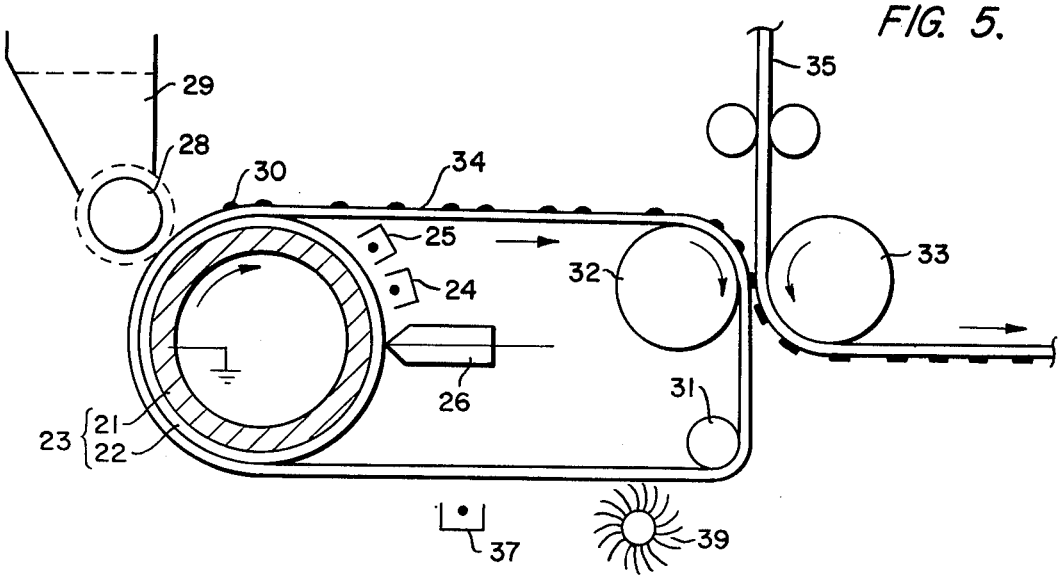
FIG. 5 is an embodiment of a structure for applying an image recording method of this invention.

FIG. 5 indicates a profile of an embodiment of a recording system utilizing an image recording method of this invention.

An electrostatic latent image recording drum 23 used in this embodiment is formed by coating or attaching an electrostatic latent image recording medium 22 consisting of the photoconductive insulation layer or dielectric layer onto the surface of a cylindrical drum 21 consisting of the conductive base material. As indicated in the figure, an endless belt shape secondary recording material 34 comes into contact with the surface of this electrostatic latent image forming drum 23 along about one-half of the drum and is supported by a plurality of rollers, such as roller 31 and roller 32. Thus, this belt shaped secondary recording material 34 runs at the same speed as the electrostatic latent image forming drum 23. Desirably, this belt shaped secondary recording material 34 should be a dielectric insulation material having a high resistance value of, for example, $10^{12}$ ohm cm to $10^{16}$ ohm cm, a thickness of, for example, 25$\mu$ to 150 $\mu$m, and a reasonable tensile strength.

More specifically, the secondary recording material 34 is preferably a belt shaped film consisting of macromolecule materials, such as polyester, polystylene, polyvinyl chloride, ethylene tetrafluoric, polypropylene, etc.

The image forming process using the above apparatus will now be sequentially explained.

First, the surface of electrostatic latent image recording drum 23 is positively or negatively charged by a charging corotron 24. Then, an electrostatic latent image is formed on the recording drum 23 by a projecting method of an ordinary duplicator or by electrostatic latent image forming means 26, such as a laser beam. In the illustrated example, the discharge is triggered by the pen electrode and the polarity inverted from the charging polarity. Thereby an electrostatic latent image is formed on the drum 23.

When the electrostatic latent image recording drum 23 is caused to rotate, developer 30 is supplied from hopper 29 to developer roller 28 from above the secondary recording material 34 as indicated in the figure at the portion of the roller 28 which is in contact with the secondary recording material 34. Thereby an electrostatic latent image is visualized by means of the developer 30. In the next step, the belt of secondary recording material 34 is further caused to rotate and a visualized image on the secondary recording material 34 is duplicated or transferred onto recording paper 35 at a location away from the electrostatic latent image recording drum 23. To achieve the duplication or transfer, any of the methods of providing an electrical field by means of a corotron for duplication or providing mechanical contact pressure by means of pressure of rollers can be employed.

In the embodiment illustrated in FIG. 5, the contact pressure duplication method by using pressure rollers 32 and 33 is employed. Element 39 is a cleaning brush, and elements 37 and 25 are discharge corotrons employed for similar functions as discussed with respect to the processes shown in FIG. 4.

Figure 6:
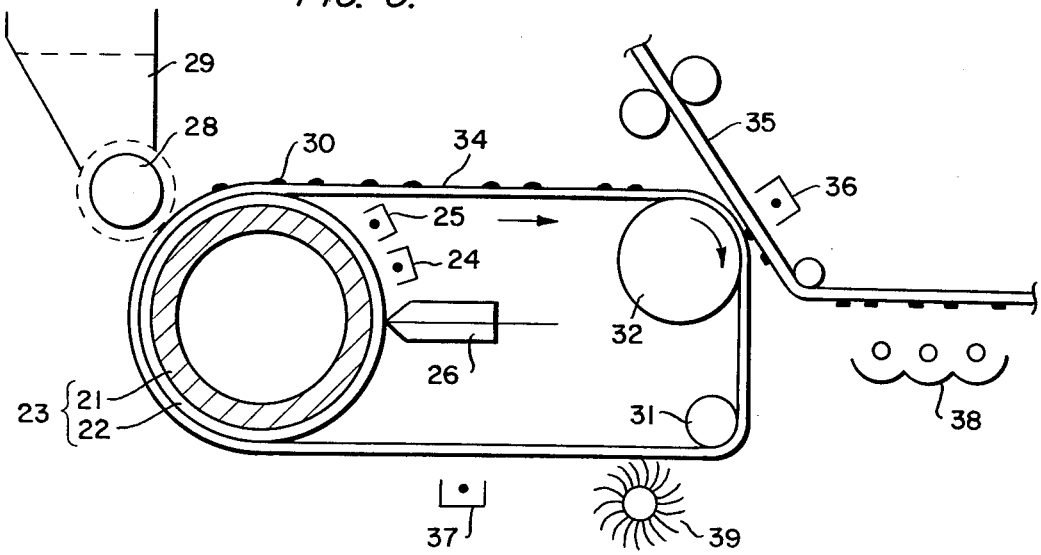
FIG. 6 is another embodiment of a practical structure for applying an image recording method of this invention.

FIG. 6 shows another embodiment of an apparatus for applying the image recording method of this invention. The difference in this apparatus from the embodiment of FIG. 5 is that a duplication corotron 36 is used for the duplication or transfer process. In FIG. 6, element 38 is an infrared ray heater provided for achieving the fixing process.

In the embodiments shown in FIG. 5 and FIG. 6, the secondary recording material 34 is further rotated after the duplication or transfer process, with the developer still remaining on the surface of the secondary recording material 34 being mechanically cleaned by means of the cleaning roller or cleaning brush 39. Moreover, the charges remaining on the secondary recording material 34 are neutralized by means of a discharger 37. Thus the series of image recording process steps is completed. The secondary recording material 34 is then again formed with a latent image from the electrostatic latent image forming drum 23 and enters the duplication process. Each of these process steps is sequentially repeated.

By way of further explanation, when the electrostatic latent image recording drum 23 is discharged by means of the discharging corotron 25 and charged by means of the charging corotron 24, and when there is discharge from the pin electrode 26 on the basis of more information, a new visualized image can be obtained on the secondary recording material 34. Moreover, when a new latent image is not formed, but instead the electrostatic latent image recording drum 23 on which a latent image was previously formed is rotated several times, the same visualized image can be formed as many times as required on the secondary recording material 34 from the same electrostatic latent image provided on drum 23.

Therefore, a plurality of recording papers 35 having the same visualized image can be obtained.

Figure 7:
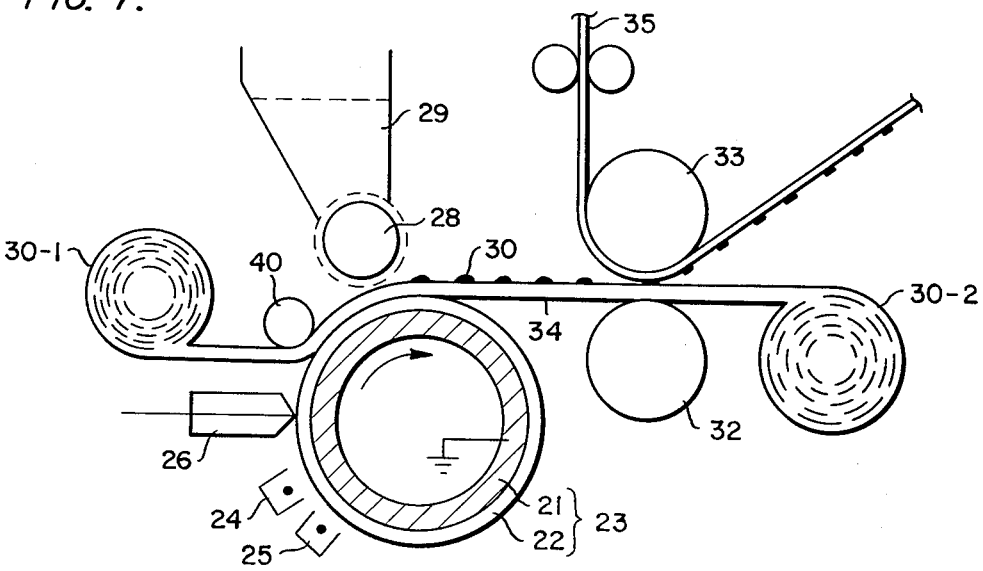
FIG. 7 is another embodiment of a practical structure for applying an image recording method of this invention.

Still another embodiment of an apparatus for applying the image recording method of this invention is shown in FIG. 7.

In the case of this embodiment, the secondary recording material 34 is wound in the form of a roll, supplied from a supply roll 30-1, and placed in contact with the electrostatic latent image recording drum 23 using a roller 40. The developer roller 28 is provided to the secondary recording material immediately adjacent of the contact area of the roller 40 and drum 23. An electrostatic latent image on the secondary recording material 34 is developed by means of the developer 30 supplied from roller 28 and then can be duplicated or transfer onto the recording paper 35 in either way illustrated for each of the embodiments of FIGS. 5 and 6 explained above. After the secondary recording material 34 is moved past the duplication location, it is wound by a take-up roll 30-2. When the supply roll 30-1 runs short, the recording material 34 can be rewound again for continuous use. Further explanation for the other elements of this apparatus and process are omitted here since these elements are the same as those described for the embodiments of FIGS. 5 and 6.

According to this invention and as explained above, a visualized image can be formed on the secondary recording material without contaminating the surface of the electrostatic latent image recording material by developer particles, melting of developer particles to the electrostatic latent image recording material, i.e., filming or coating of the recording material can be prevented, and an excellent electrostatic latent image can always be formed on this recording material. It is a significant feature of this invention that a plurality of visualized images can be obtained from the same electrostatic latent image and a plurality of duplicated images can be obtained on ordinary recording paper.

What is claimed is:

1. An image recording method comprising the steps of:

(a) forming an electrostatic latent image corresponding to an image to be recorded on the surface of an electrostatic latent image forming material, said forming step comprising the steps of (i) first uniformly neutralizing any charges on the electrostatic latent image forming material with a discharging corotron, (ii) then uniformly charging the surface of the electrostatic latent image forming material with a charging corotron, and (iii) then forming an electrostatic latent image on said surface through discharging by applying a voltage to a pin electrode in non-contact very close to the surface of the electrostatic latent image forming material, (b) laying a recording material having a high resistance value and dielectric coefficient on said electrostatic latent image forming material, (c) visualizing an electrostatic latent image on said recording material corresponding to the electrostatic latent image of said electrostatic latent image forming material by supplying developer to the surface of said recording material not facing said electrostatic latent image forming material, (d) laying an ordinary recording paper on said recording material storing the visualized image, (e) duplicating the visualized image formed on said recording material onto said ordinary recording paper by duplication means, and (f) fixing the developer on said ordinary recording paper.

2. An image recording method in accordance with claim 1 further comprising the steps of:

removing said ordinary recording paper from said recording material after said visualized image is duplicated onto said paper, again laying said recording material on said electrostatic latent image forming material, again supplying developer to the surface of said recording material, and laying another new ordinary recording paper on said recording material for duplication, wherein a plurality of ordinary recording papers having a plurality of visualized images can be obtained from the same electrostatic latent image on said electrostatic latent image forming material.

3. An image recording method in accordance with claim 1 or 2, wherein said duplication means is composed of a corona charger.

4. An image recording method in accordance with claim 1 or 2, wherein said duplication means is composed of pressure rollers.

5. An image recording method in accordance with claim 1 or 2, wherein said electrostatic latent image forming material is composed of a conductive base material and a dielectric layer formed on said conductive base material, and wherein multi-pin electrodes are provided face to face adjacent the surface of said electrostatic latent image forming material.

6. An image recording method in accordance with claim 1 or 2, wherein said recording material has a resistance value of $10^{12}$ (ohm cm) to $10^{16}$ (ohm cm) and a dielectric coefficient of 1.2 to 3.5.

7. An image recording method in accordance with claim 1, wherein said electrostatic latent image forming material is of a cylindrical drum shape, and said recording material is of an endless belt shape placed in contact with the surface of the cylindrical drum shape, electrostatic latent image forming material, said recording material being rotated at the same speed as the rotating speed of said electrostatic latent image forming material, and wherein in step (a) the electrostatic latent image is formed on said electrostatic latent image forming material by the discharging pin electrode at an area on the surface of said electrostatic latent image forming material not coming into contact with said recording material, in step (c) a visualized image in the same shape as the electrostatic latent image on said electrostatic latent image forming material is formed on said recording material by supplying the developer from the side of said recording material in an area coming into contact with said recording material, and wherein in steps (d) and (e) said recording material is rotated, and the visualized image formed on said recording material is duplicated onto the recording paper in an area apart from said electrostatic latent image forming material.

8. An image recording method in accordance with claim 1, wherein said electrostatic latent image forming material is of a cylindrical drum shape, and said recording material is a belt shape recording material wound to a supply roll and take-up roll at both ends and placed in contact with the surface of the cylindrical drum shape electrostatic latent image forming material, said recording material being rotated at the same speed as the rotating speed of said electrostatic latent image forming material, and wherein in step (a) the electrostatic latent image is formed on said electrostatic latent image forming material by the discharging pin electrode at an area on the surface of said electrostatic latent image forming material not coming into contact with said recording material, in step (c) a visualized image in the same shape as the electrostatic latent image on said electrostatic latent image forming material is formed on said recording material by supplying the developer from the side of said recording material in an area coming into contact with said recording material, and wherein in steps (d) and (d) said recording material is rotated and the visualized image formed on said recording material is duplicated onto a recording paper at an area apart from said electrostatic latent image forming material.

9. An image recording method in accordance with claim 7 or 8, further comprising the step of removing the developer remaining on said recording material after duplication by cleaning means, and repeating the process steps for development and duplication of the latent image through repeated rotation of said electrostatic latent image forming material and said recording material, wherein a plurality of recording papers containing a visualized image can be obtained from the same electrostatic latent image formed on said electrostatic latent image forming material.

10. An image recording method in accordance with claim 7 or 8, wherein said duplication means is composed of a corona charger.

11. An image recording method in accordance with claim 7 or 8, wherein said duplication means is composed of pressure rollers.

12. An image recording method in accordance with claim 7 or 8, wherein said electrostatic latent image forming material is composed of a conductive base material and a dielectric layer formed on said conductive base material, multi-pin electrodes are provided face to face adjacent the surface of said electrostatic latent image forming material, and an electrostatic latent image corresponding to an image to be recorded is formed by discharge occurring when a voltage is applied to said multi-pin electrodes.

13. An image recording method in accordance with claim 7 or 8, wherein said recording material has a resistance value of $10^{12}$ (ohm cm) to $10^{16}$ (ohm cm) and a dielectric coefficient of 1.2 to 3.5.

14. An image recording method in accordance with claim 13, wherein said recording material has a thickness of from 25 m to 150 m.

15. An image recording method in accordance with claim 7 or 8, wherein said recording material is formed of a macromolecule material.

16. An image recording method in accordance with claim 2, 7 or 8, wherein the step (a) (i) of discharging the electrostatic latent image formed on said electrostatic latent image forming material is performed after a predetermined number of said recording papers containing the same visualized image have been obtained.

17. An image recording method in accordance with claim 9, wherein the step (a) (i) of neutralizing charges comprises discharging charges remaining on said recording material after duplication by the discharging corotron and wherein the method further comprises repeating the process steps for development and duplication.

* * * * *

UNITED STATES PATENT AND TRADEMARK OFFICE

CERTIFICATE OF CORRECTION

PATENT NO. : 4,458,258

DATED : Amaya et al.

INVENTOR(S) : July 3, 1984

It is certified that error appears in the above-identified patent and that said Letters Patent is hereby corrected as shown below:

Column 4, line 5, after "having" insert --a--;
Column 4, line 11, "chrolide" should be --chloride--.
Column 6, line 53, "25μ" should be --25μm--;
Column 6, line 68, "pen" should be --pin--.

Signed and Sealed this

*Twentieth* Day of *November 1984*

[SEAL]

*Attest:*

GERALD J. MOSSINGHOFF

*Attesting Officer*

*Commissioner of Patents and Trademarks*